US008031040B1

(12) United States Patent
Folker et al.

(10) Patent No.: US 8,031,040 B1
(45) Date of Patent: Oct. 4, 2011

(54) MAGNETIC COMPONENT HAVING A BOBBIN STRUCTURE WITH INTEGRATED WINDING

(75) Inventors: Donald Folker, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 12/698,226

(22) Filed: Feb. 2, 2010

(51) Int. Cl.
*H01F 27/30* (2006.01)
*H01F 27/29* (2006.01)

(52) U.S. Cl. ..... 336/198; 336/208; 336/192

(58) Field of Classification Search ..... None
See application file for complete search history.

(56) References Cited

U.S. PATENT DOCUMENTS

| | | | | |
|---|---|---|---|---|
| 3,987,488 | A | 10/1976 | Kanai et al. | |
| 4,616,205 | A | 10/1986 | Praught et al. | |
| 4,965,712 | A | 10/1990 | Duspiva et al. | |
| 5,034,854 | A * | 7/1991 | Matsumura et al. | 361/744 |
| 5,068,509 | A | 11/1991 | Paufve et al. | |
| 5,631,822 | A | 5/1997 | Silberkleit et al. | |
| 5,748,065 | A * | 5/1998 | Hashimoto et al. | 336/96 |
| 6,072,380 | A | 6/2000 | Monroe | |
| 6,127,912 | A * | 10/2000 | Dust et al. | 336/208 |
| 6,151,770 | A * | 11/2000 | Hashimoto et al. | 29/605 |
| 6,223,421 | B1 | 5/2001 | Lanoue et al. | |
| 6,320,490 | B1 | 11/2001 | Clayton | |
| 7,411,477 | B2 * | 8/2008 | Watanabe | 336/192 |
| 2004/0195651 | A1 | 10/2004 | Zhang et al. | |
| 2005/0183514 | A1 | 8/2005 | Huybrechts et al. | |
| 2005/0212640 | A1 | 9/2005 | Chiang et al. | |
| 2006/0244561 | A1 * | 11/2006 | Iwakura et al. | 336/212 |

FOREIGN PATENT DOCUMENTS

| | | | |
|---|---|---|---|
| JP | 07029514 | * | 1/1995 |

* cited by examiner

*Primary Examiner* — Anh Mai
(74) *Attorney, Agent, or Firm* — Waddey & Patterson; Mark J. Patterson; Matthew C. Cox

(57) ABSTRACT

A magnetic component has a bobbin structure for winding a conductive material. The bobbin structure includes a bobbin body having a first winding embedded in the bobbin body. The first winding is made of a conductive material. The first winding includes a winding body and two terminal ends. The terminal ends protrude from the bobbin body for connection to a circuit. The winding body of the first winding is embedded inside the bobbin body. Alternatively, the first conductive winding is embedded in a bobbin flange included on the bobbin body. The bobbin structure generally includes a hollow interior cavity shaped for inserting a ferrite core.

20 Claims, 3 Drawing Sheets

MAGNETIC COMPONENT HAVING A BOBBIN STRUCTURE WITH INTEGRATED WINDING

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not applicable.

BACKGROUND OF THE INVENTION

The present invention relates generally to a magnetic component having at least one conductive winding and more specifically to a magnetic component having a bobbin structure for winding a conductive coil. More particularly the present invention relates to a bobbin structure having a molded bobbin body including a first conductive winding embedded therein.

Magnetic components utilizing a bobbin structure for positioning a conductive winding are known in the prior art. These components, including certain transformers and inductors, are commonly used in power supply circuits, such as those found in lighting assemblies and other electronic devices. Such components are often referred to as bobbin-wound components.

Generally, in a bobbin-wound component, at least one coil, or winding, of conductive material is wound around a bobbin structure. Typically, the bobbin structure includes a hollow cavity for inserting a ferrite core. The winding is placed around the exterior of the bobbin structure surrounding the hollow cavity. During use, current is passed through at least one conductive coil, and a magnetic field is generated by the flow of electrons through the coil. The magnetic field is guided and concentrated by the ferrite core positioned in the hollow cavity. Each conductive coil in a bobbin-wound component may include of one or more turns around the bobbin structure. The performance of the component is determined in part by the number of turns of each conductive coil around the bobbin structure and by the position of each coil on the bobbin structure.

A common prior art bobbin-wound component configuration includes a bobbin structure having a hollow interior cavity, a first conductive coil wound onto the bobbin structure and a second conductive coil wound onto the same bobbin structure. In many applications, it is desirable for the first coil to include a conductive wire wound less than one complete revolution around the bobbin structure. A coil forming less than one complete revolution around the bobbin structure is referred to as a single-turn winding. In such a component, the placement of the single-turn winding must be precise for the component to function as intended. Even a minor deviation from the proper single-turn winding placement can result in component failure.

For example, in the prior art, a single-turn winding is typically positioned on the exterior of the bobbin structure. As such, the single-turn winding may shift along the exterior of the bobbin structure during use, resulting in component malfunction or failure. The prior art also teaches a magnetic component having an individual insulated single-turn winding that can be inserted into a bobbin structure. In the prior art, the bobbin structure and the insertable single-turn winding are separate pieces, and the single-turn winding may shift relative to the bobbin structure during use, causing undesired performance fluctuations or component failure. Also, the two-piece design of the prior art adds complexity to the design of the bobbin structure, requiring multiple components.

Other conventional bobbin-wound components generally include multiple windings positioned on one bobbin structure. The windings include a conductive wire coated with electrically insulating enamel. The coated wire is wound around the bobbin structure to form each winding. The enamel on the wire is included to prevent electrical contact between each winding. However, conventional bobbin-wound components allow partially exposed regions of the windings to occasionally form an undesired electrical contact between the windings. Electrical contact between windings can cause component failure.

The conventional practice for producing bobbin-wound components includes positioning the single-turn winding onto the bobbin structure using a winding machine. The rate of production of bobbin-wound components having a single-turn winding is often limited by the time required for the winding machine to properly position the single-turn winding onto the bobbin structure. Precise positioning of the single-turn winding generally increases the overall component winding time and, thus, limits the overall rate of bobbin-wound component production.

Accordingly, there is a need in the art for providing a magnetic component having a bobbin structure with an integrated winding for reducing component production time, providing electrical insulation between windings and reducing component failure due to misplaced single-turn windings.

BRIEF SUMMARY

The present invention is a magnetic component having a bobbin structure. The bobbin structure includes a bobbin body and a first winding. The first winding may be a single-turn conductive wire. The first winding includes a winding body and two terminal ends. The winding body of the first winding is embedded in the bobbin body. Each terminal end of the first winding protrudes from the bobbin body for connection to a circuit. In one embodiment, the terminal ends are configured for soldering onto a printed circuit board. Multiple conductive windings can be embedded in a single bobbin body.

The bobbin body also includes a winding region. The winding region is generally a location on the outer surface of the bobbin body for placing a bobbin winding. A bobbin winding is a separate conductive coil positioned in the winding region. In one embodiment for a transformer, the first winding is a primary winding and the bobbin winding is a secondary winding.

The winding region can include a recessed area of the bobbin body for positioning the bobbin winding. In an alternative embodiment, the bobbin body can include a bobbin flange extending from the bobbin body. The bobbin flange is molded from the same material as the bobbin body. The first winding is embedded in the bobbin flange. Multiple bobbin flanges may extend from the bobbin body. Each bobbin flange may include an embedded winding. An intermediate bobbin flange may divide the winding region into separate winding regions. An intermediate flange may also include an embedded winding. The bobbin body also includes a hollow cavity shaped for inserting a ferrite core. The first winding is typically positioned embedded in the bobbin structure so that the winding body of the first winding at least partially surrounds the hollow cavity.

It is therefore a general object of the present invention to provide a magnetic component having a bobbin structure including at least one conductive winding embedded in the body of the bobbin structure.

It is another object of the present invention to provide a bobbin structure having a single-turn conductive winding embedded in the bobbin body for reducing the time required for production of a bobbin-wound magnetic component.

It is yet another object of the present invention to provide an improved magnetic component having a bobbin structure with an insulated winding for preventing electrical contact between separate windings.

It is yet another object of the present invention to provide a bobbin structure having multiple conductive windings embedded in one bobbin structure.

Another object of the present invention is to provide a magnetic component having an accurately positioned single-turn winding.

Another object of the present invention is to provide a bobbin structure with an embedded winding including terminal ends for soldering onto a printed circuit board.

Numerous other objects, features and advantages of the present invention will be readily apparent to those skilled in the art, upon a reading of the following disclosure, when taken in conjunction with the accompanying drawings.

DETAILED DESCRIPTION

Figure 1:
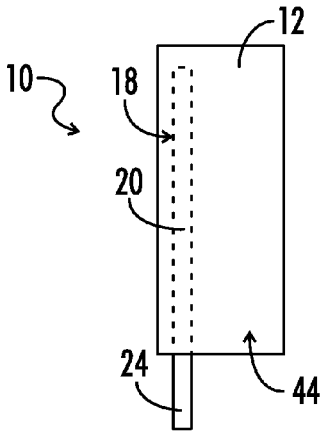
FIG. 1 is a side view of a first embodiment of a bobbin structure in accordance with the present invention.
Figure 2:
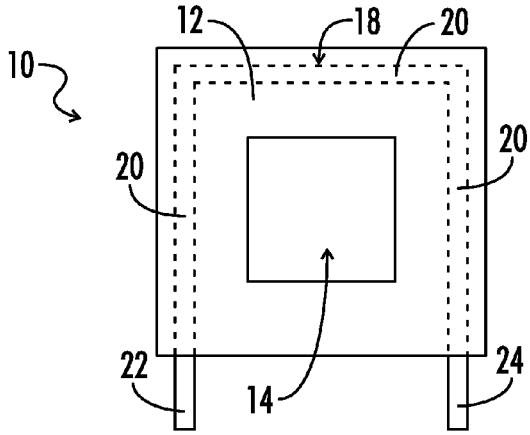
FIG. 2 is an end view of the bobbin structure of FIG. 1.

Referring now to FIG. 1 and FIG. 2, there is shown generally one embodiment of a bobbin structure 10 in accordance with the present invention. The bobbin structure 10 includes a bobbin body 12, a winding region 44 positioned on the bobbin body 12, and a first winding 18 embedded in the bobbin body 12. The first winding 18 includes a winding body 20, a first terminal end 22 and a second terminal end 24, as shown in FIG. 2. The first winding 18 is generally made of an electrically conductive material, and the bobbin body 12 is generally made of an electrically insulative material. A terminal end is defined as a region of a winding that extends from the bobbin body 12 for connection to an electric circuit. The first terminal end 22 and the second terminal end 24 are not embedded in the bobbin body 12. In one embodiment, the winding body 20 of the first winding 18 is completely embedded in the bobbin body 12. Also shown in FIG. 2, the bobbin body 12 includes a hollow interior cavity 14. The first winding 18 is embedded in the bobbin body 12 partially surrounding the hollow interior cavity 14.

Figure 3:
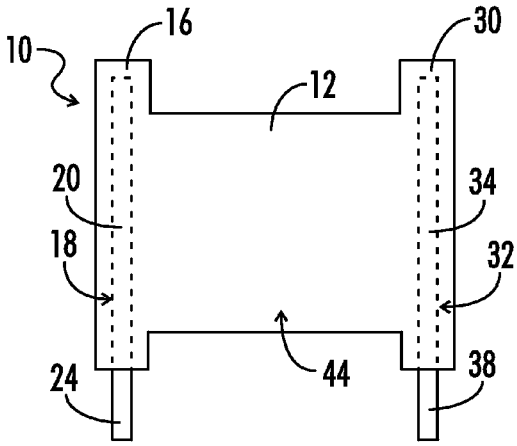
FIG. 3 is a side view of a second embodiment of a bobbin structure in accordance with the present invention.

Referring now to FIG. 3, another embodiment of a bobbin structure 10 in accordance with the present invention is shown. The bobbin structure 10 includes a bobbin body 12 having a first bobbin flange 16 and a second bobbin flange 30. Both bobbin flanges 16, 30 extend from the bobbin body 12. In an alternative embodiment, the bobbin body 12 may include only one bobbin flange 16. Also shown in FIG. 3, a first winding 18 and a second winding 32 are embedded in the bobbin body 12. In one embodiment, the first winding 18 may be embedded in the first bobbin flange 16 and the second winding 32 may be embedded in the second bobbin flange 30. The first bobbin flange 16 and the second bobbin flange 30 are separated by a winding region 44. The first bobbin flange 16 and the second bobbin flange 30 are positioned at opposite ends of the bobbin body 12. In other embodiments, the first bobbin flange 16 or second bobbin flange 30 may be positioned closer to the center of the winding region 44. In one embodiment not shown, the first winding 18 and the second winding 32 may be electrically connected across a circuit board that the bobbin structure 10 is mounted on, forming a multiple-turn winding.

Figure 4:
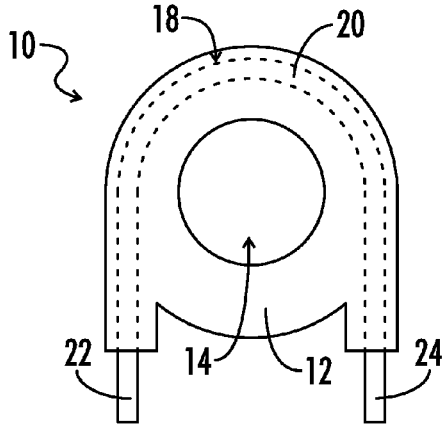
FIG. 4 is an end view of a third embodiment of bobbin structure in accordance with the present invention.

The bobbin body 12 may have a hollow rectangular cross-section, as shown in FIG. 2. In another embodiment, the bobbin body 12 may have a rounded cross-sectional profile, as shown in FIG. 4. Similarly, the hollow interior cavity 14 may have a rectangular cross-section as shown in FIG. 2 or a circular cross-section as shown in FIG. 4. Other embodiments include a bobbin body 12 and a hollow interior cavity 14 having various other cross-sectional profiles. In one embodiment, the bobbin body 12 generally has the shape of a hollow cylinder and the first winding 18 includes a winding body 20 having an arcuate semicircular shape.

Figure 5:
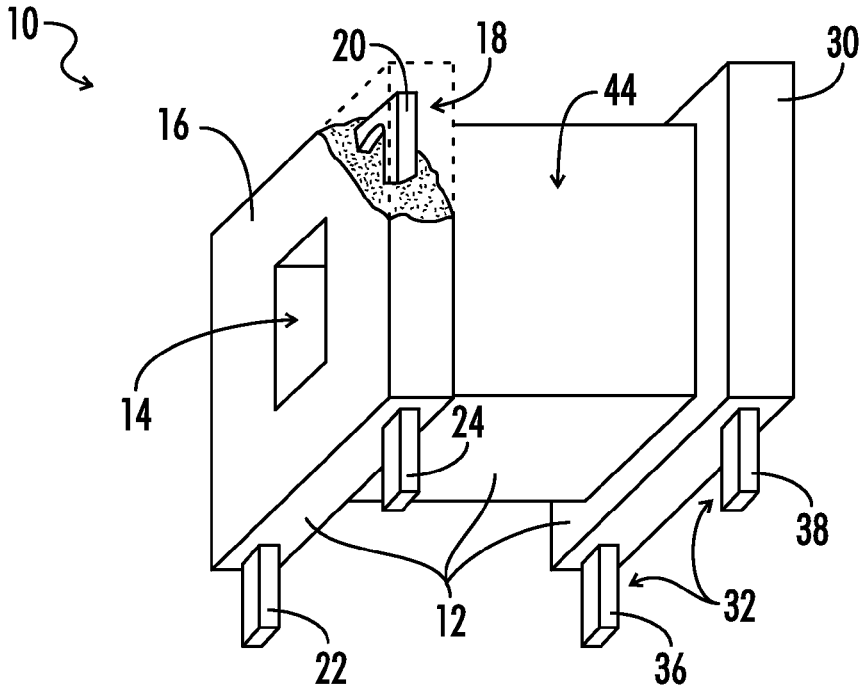
FIG. 5 is a perspective view of the bobbin structure of FIG. 3.

Referring now to FIG. 5, one embodiment of a bobbin structure 10 in accordance with the present invention is shown. The bobbin structure 10 includes a bobbin body 12, a first winding 18 and a second winding 32. The first winding 18 includes a first terminal end 22 and a second terminal end 24. The second winding 32 includes a third terminal end 36 and a fourth terminal end 38. In one embodiment, the first winding 18 and the second winding 32 are both single-turn windings. A single-turn winding may be a conductive material forming an open loop shaped for partially surrounding the hollow interior cavity 14 of the bobbin body 12. In other embodiments in accordance with the present invention, the first or second windings 18, 32 may be multiple turn windings.

Figure 6:
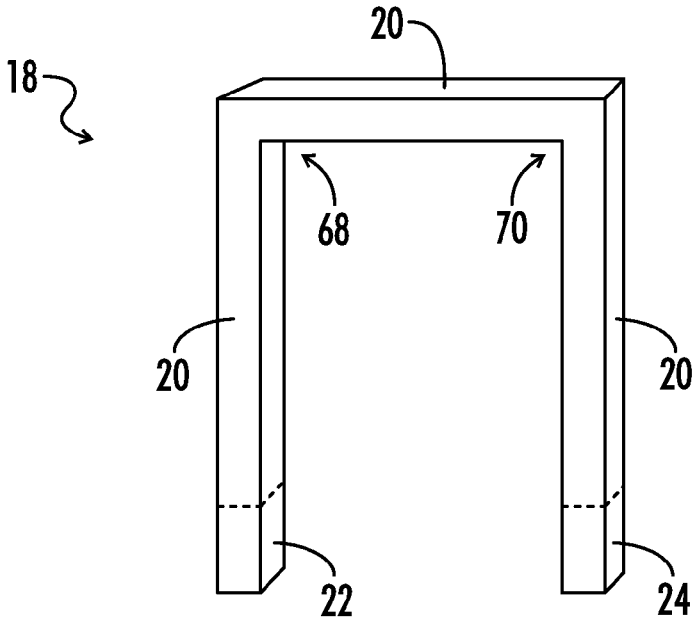
FIG. 6 is a perspective view of a single-turn winding in accordance with the present invention.

One embodiment of a single-turn winding is shown in FIG. 6. The winding 18 is a single-turn winding, including a winding body 20 having a rectangular "U" shape. The winding body 20 includes a first bend 68 and a second bend 70. In other embodiments, the winding body 20 of the winding 18 may have a rounded or semicircular shape, as shown in FIG. 4. Additionally, the winding 18 may have a rectangular or a rounded cross-section.

Figure 8:
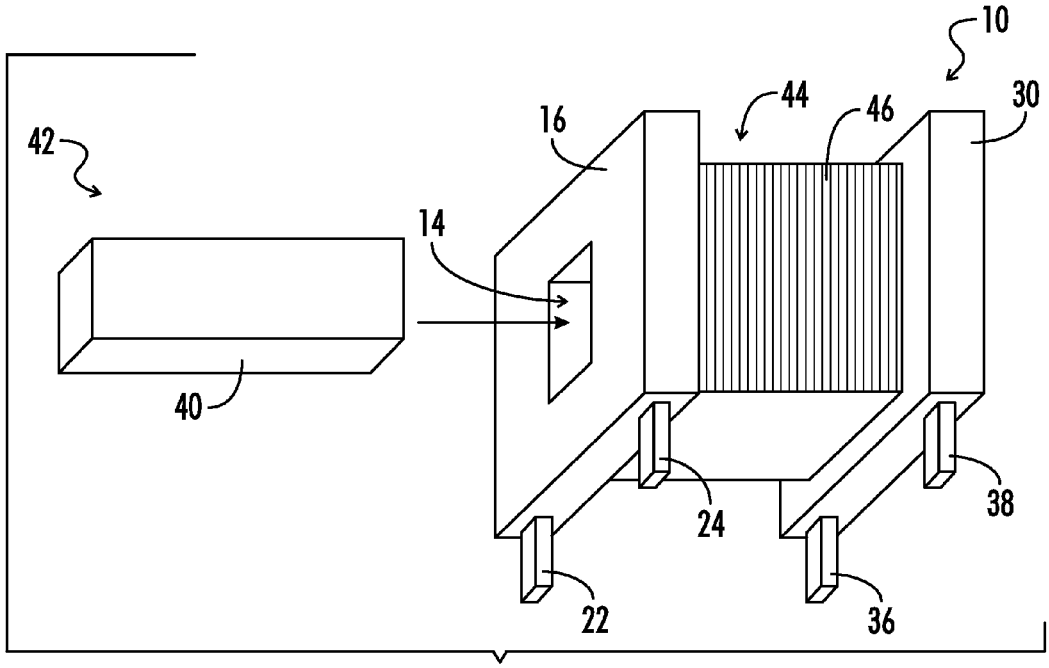
FIG. 8 is a perspective view of a bobbin-wound magnetic component having a bobbin structure in accordance with the present invention.

Referring again to FIG. 5, the bobbin body 12 includes a winding region 44 positioned around the bobbin body 12. In one embodiment, the winding region 44 of the bobbin body 12 includes a location on the outer surface of the bobbin body 12 shaped to support a bobbin winding 46, as shown in FIG. 8. A bobbin winding 46 is a coil of conductive material positioned in the winding region 44. The bobbin winding 46 can be a single- or a multiple-turn winding.

As shown in FIG. 5, the first winding 18 and the second winding 32 are embedded in the bobbin body 12. An embedded winding may be a winding that includes a winding body 20 molded into or otherwise surrounded by a bobbin body 12. An embedded winding can not be slidably inserted into or detached from the bobbin body 12, but is rather integrated into the material of the bobbin body 12. In one embodiment, shown in FIG. 5, both the first winding 18 and the second winding 32 are embedded in the bobbin body 12 by molding the bobbin body 12 around the first winding 18 and second winding 32.

The bobbin body 12 can be molded from a variety of bobbin materials known in the art, for example either a thermoplastic polymer or a synthetic resin. In one embodiment, the first bobbin flange 16, the second bobbin flange 30, the winding region 44, the first winding 18 and the second winding 32 are integrally molded as one bobbin structure 10. An integrally molded structure may be a structure formed from a single mold, wherein the features of the structure are defined in the mold.

In an exemplary embodiment, a bobbin structure 10 is integrally molded by initially placing a first winding 18 and a second winding 32 into a mold. The first winding 18 is positioned so that its first terminal end 22 and the second terminal end 24 extend from the mold. The second winding 32 is positioned so that the third terminal end 36 and fourth terminal end 38 extend from the mold. The mold is shaped to define the features of the bobbin body 12, including a first bobbin flange 16, a second bobbin flange 30, a winding region 44 and a hollow interior cavity 14. A bobbin material is then injected into the mold so that the bobbin material surrounds the first winding 18 and the second winding 32 without surrounding the terminal ends 22, 24 of the first winding 18 or the terminal ends 36, 38 of the second winding 32. After the injected material cures, the bobbin structure 10 is removed from the mold. The molded bobbin structure 10 includes an integrated first winding 18 and an integrated second winding 32, as shown in FIG. 5.

Figure 7:
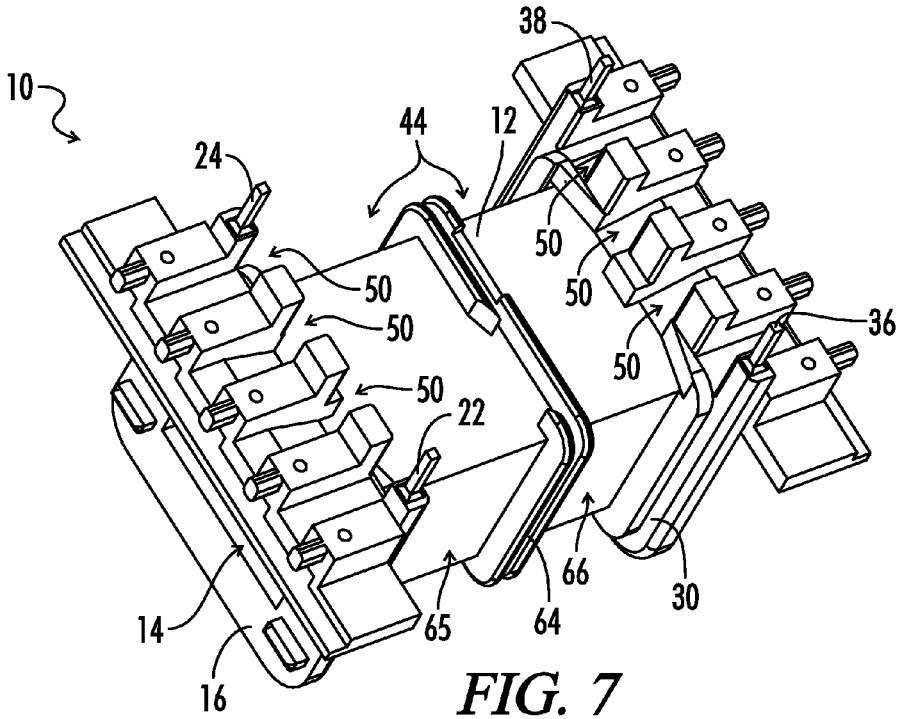
FIG. 7 is a perspective view of an embodiment of a bobbin structure in accordance with the present invention.

Referring now to FIG. 7, another embodiment of a bobbin structure 10 in accordance with the present invention is shown. The bobbin structure 10 includes a bobbin body 12 defining one or more notched regions 50. In one embodiment, a notched region 50 is positioned on the first flange 16. Similarly, the second flange 30 may include one or more notched regions 50. Also shown in FIG. 7, one embodiment includes an intermediate flange 64 positioned on the bobbin body 12. An intermediate flange may be a flange extending from the bobbin body 12 between the first flange 16 and the second flange 30. The intermediate flange 64 can separate the winding region 44 into a first winding region 65 and a second winding region 66. In an alternative embodiment, the intermediate flange 64 includes a single-turn winding 18 embedded in the intermediate flange 64.

Referring now to FIG. 8, a magnetic component 42 having a bobbin structure 10 in accordance with the present invention is shown. A core 40 is inserted into the hollow cavity 14 of the bobbin structure 10. In one embodiment, the core 40 is made of a ferrite. In accordance with the present invention, the core 40 may have various shapes, including the shape of an E-core, a U-core or variations thereof. Also shown in FIG. 8, a bobbin winding 46 is positioned on the winding region 44 of the bobbin structure 10. The bobbin winding 46 may include one or more revolutions of a conductive material wound around the winding region 44 of the bobbin body 12. In another embodiment, the bobbin winding 46 is embedded in the bobbin body 12. In one embodiment, the magnetic component 42 is a transformer. The magnetic component 42 may be configured so that the terminal ends 22, 24, 36, 38 can be soldered onto a printed circuit board.

Thus, although there have been described particular embodiments of the present invention of a new and useful magnetic component having a bobbin structure with an integrated winding, it is not intended that such references be construed as limitations upon the scope of this invention except as set forth in the following claims.

What is claimed is:

1. A bobbin structure for winding a bobbin winding, comprising:

a bobbin body including a winding region shaped for receiving the bobbin winding, the bobbin body defining a hollow interior cavity; and the bobbin body including a first winding embedded in the bobbin body, the first winding including a winding body, a first terminal end and a second terminal end, the first and second terminal ends of the first winding protruding from the bobbin body for connection to a circuit.

2. The bobbin structure of claim 1, wherein the first winding is a single-turn winding.

3. The bobbin structure of claim 1, wherein the first winding is a multiple-turn winding.

4. The bobbin structure of claim 1, further comprising:

the bobbin body having a generally rectangular cross-section; and the winding body of the first winding including a first bend and a second bend.

5. The bobbin structure of claim 1, further comprising:

the bobbin body generally having the shape of a hollow cylinder; and the winding body of the first winding having an arcuate semicircular shape.

6. The bobbin structure of claim 1, further comprising a second bobbin winding disposed about the winding region of the bobbin body, the second bobbin winding comprising a conductive material.

7. The bobbin structure of claim 1, further comprising a second bobbin winding embedded in the bobbin body, the second bobbin winding comprising a conductive material.

8. The bobbin structure of claim 1, further comprising a second winding including a winding body, a third terminal end and a fourth terminal end, the winding body of the second winding embedded in the bobbin body, each of the terminal ends of the second winding protruding from the bobbin body for connection to a circuit.

9. The bobbin structure of claim 8, wherein the second winding is a single-turn winding.

10. The bobbin structure of claim 8, further comprising a bobbin winding disposed about the winding region of the bobbin body, the bobbin winding being wound at least one revolution around the winding region of the bobbin body, the bobbin winding positioned between the first winding and the second winding.

11. The bobbin structure of claim 1, further comprising a ferrite core positioned inside the hollow interior cavity of the bobbin body.

12. A bobbin structure for a magnetic component comprising:

a bobbin body having a first end and a second end, the bobbin body including an exterior winding surface, the bobbin body defining a hollow interior cavity;

a first bobbin flange extending from the bobbin structure; and a first single-turn winding including a winding body, a first terminal end and a second terminal end, the winding body of the first single-turn winding embedded in the first bobbin flange, the first and second terminal ends protruding from the bobbin body for connection to a circuit, the first single-turn winding comprising an electrically conductive material.

13. The bobbin structure of claim 12, wherein the bobbin body is integrally molded with the first flange.

14. The bobbin structure of claim 13, further comprising a second bobbin flange extending from the bobbin body.

15. The bobbin structure of claim 14, further comprising a second single-turn winding, the second single-turn winding including a winding body, a third terminal end and a fourth terminal end, the winding body of the second single-turn winding embedded in the second bobbin flange, each third and fourth terminal end of the second single-turn winding protruding from the bobbin body for connection to a circuit, the second single-turn winding comprising an electrically conductive material.

16. The bobbin structure of claim 12, further comprising:

a bobbin winding disposed about the winding region of the bobbin body; and a ferrite core positioned in the hollow interior cavity of bobbin body.

17. A bobbin-wound component for a magnetic circuit, comprising:

a ferrite core; and a bobbin structure comprising an electrically insulative material, the bobbin structure including:

a bobbin body including a winding region, the bobbin body defining a hollow interior cavity shaped for receiving the ferrite core;

a first bobbin flange extending from the bobbin body, the first bobbin flange integrally molded with the bobbin body;

a first winding embedded inside the first bobbin flange, the first winding including a winding body, a first terminal end and a second terminal end, each first and second terminal end protruding from the bobbin body, the first winding comprising a conductive material; and a bobbin winding positioned on the winding region of the bobbin structure.

18. The bobbin-wound component of claim 17, further comprising the bobbin body including a second bobbin flange extending from the bobbin body, the second bobbin flange being integrally molded with the bobbin body.

19. The component of claim 18 further comprising a second winding including a winding body, a third terminal end and a fourth terminal end, the winding body of the second winding embedded in the second bobbin flange, each terminal end of the second winding protruding from the bobbin body.

20. The component of claim 19 further comprising an intermediate flange extending from the bobbin body positioned between the first bobbin flange and the second bobbin flange, the intermediate flange defining a first winding region positioned between the first bobbin flange and the intermediate flange and a second winding region positioned between the intermediate flange and the second bobbin flange.

* * * * *